United States Patent [19]

Huang

[11] Patent Number: 4,626,970

[45] Date of Patent: Dec. 2, 1986

[54] ORNAMENTAL CASING ASSEMBLY FOR CEILING FAN

[76] Inventor: Ming C. Huang, 788, Chung Shan Rd., Tai Chung Hsien, Taiwan

[21] Appl. No.: 758,277

[22] Filed: Jul. 24, 1985

[51] Int. Cl.[4] ..... F21S 1/02; F04D 29/64

[52] U.S. Cl. ..... 362/147; 362/806; 362/294; 416/5

[58] Field of Search ..... 362/147, 806, 294; 416/5

[56] References Cited

U.S. PATENT DOCUMENTS

| | | | |
|---|---|---|---|
| 4,342,072 | 7/1982 | Ranten | 362/147 |
| 4,382,400 | 5/1983 | Stutzman | 416/5 |
| 4,402,649 | 9/1983 | Laurel | 416/5 |
| 4,428,032 | 1/1984 | Workman | 362/294 |

*Primary Examiner*—E. Rollins Cross
*Attorney, Agent, or Firm*—Kenyon & Kenyon

[57] ABSTRACT

The present invention discloses an improved ornamental casing assembly for a ceiling fan, and comprises an upper shell; a lower shell; a plurality of connecting members fastened between the upper shell and the lower shell, and separating the upper shell and the lower shell; a plurality of light-pervious plates mounted between the upper shell and the lower shell and between the connecting members respectively; a plurality of retaining members secured to the connecting members respectively for retaining the light-pervious plates firmly on the connecting members; and a light member mounted within the space enveloped by the upper and lower shells, and the light-pervious plates.

5 Claims, 5 Drawing Figures

ORNAMENTAL CASING ASSEMBLY FOR CEILING FAN

BACKGROUND OF THE INVENTION

The present invention relates to an ornamental casing assembly for a ceiling fan, and more particularly to an improved ornamental casing which can be easily assembled, repaired, and transported.

The former ceiling fan is generally formed by a motor exposed in the air and a fan impeller fastened to the driving shaft of the motor. Subsequently, for ornamental purposes, a ceiling fan having an ornamental casing is proposed, such as shown in FIGS. 1 and 2. The ceiling fan includes an ornamental casing 2 placed above the fan impeller 10, and enclosing the motor 1. The ornamental casing 2 is made up of an upper shell 21, a lower shell 23, and a hollow glass cylinder 22. The hollow glass cylinder 22 is integrally formed, and located between the upper and lower shells 21 and 23. The upper shell 21 and the lower shell 23 are connected by four bolts 3 with the glass cylinder 22 retained therebetween by means of their folded peripheries. Four lamps 4 are mounted to the inner surface of the upper shell 21 respectively. Accordingly, the lamps 4 combined with the glass cylinder 22 can provide an ornamental lighting. However, such a ceiling fan having an ornamental casing still has several shortcomings as follows:

(a) Since the glass cylinder is fixed merely by the bolts and the peripheries of the upper and lower shells, the glass cylinder is frequently broken due to vibration, pressure, or external impact during transportation. In addition, since the glass cylinder is integrally formed, the entire glass cylinder must be replaced when it is broken or cracked, and so the cost increases undesirably.

(b) It is troublesome to replace the broken glass cylinder, and the lamp. Firstly, the fan impeller and the elements mounted under the lower shell must be removed, and the lower shell is separated from the upper shell by disengaging the four bolts. Then, a new glass cylinder or new lamp is mounted. Finally, the lower shell, the fan impeller, and the removed elements are remounted.

(c) Further, when replacing the glass cylinder or the lamp, the dust accumulated within the ornamental casing will fall onto the body or into the eyes of the repairman.

SUMMARY OF THE INVENTION

The primary object of the present invention is to provide an ornamental casing assembly for a ceiling fan which is easily assembled, disassembled, and transported, and which can significantly reduce the likelihood of breaking the fragile elements by vibration, pressure, or external impact.

The further object of the present invention is to provide an ornamental casing assembly which utilizes a plurality of light-pervious plates to form a cylinder like the glass cylinder of the prior art, but so that only the broken light-pervious plate or plates needs to be replaced, with the other intact plates remaining as they are.

The further object of the present invention is to provide an ornamental casing assembly which structure facilates the replacement of the light-pervious plates and the light members mounted within the ornamental casing.

In accordance with the present invention, an improved ornamental casing assembly for a ceiling fan comprises an upper shell; a lower shell; a plurality of connecting members fastened between the upper shell and the lower shell, and separating the upper shell and the lower shell; a plurality of light-pervious plates mounted between the upper shell and the lower shell and between the connecting members respectively; a plurality of retaining members secured to the connecting members respectively for retaining the light-pervious plates firmly on the connecting member; and a light member mounted within the space enveloped by the upper and lower shells and the light-pervious plates.

BRIEF DESCRIPTION OF THE DRAWINGS

The present invention will be more fully understood from the following detailed description, taken in connection with the accompanying drawings which form an integral part of this application and in which.

DETAILED DESCRIPTION OF THE PREFERRED EMBODIMENT

Figure 1:
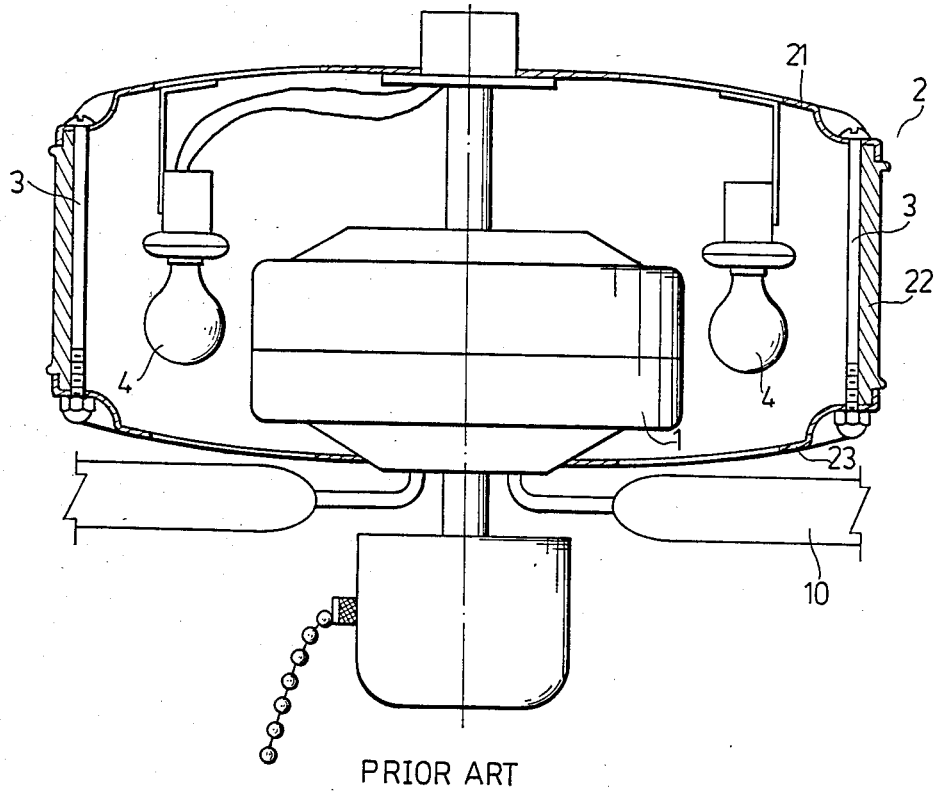
PRIOR ART FIG. 1
FIG. 1 is an elevational view of a conventional ceiling fan having an ornamental casing, with the casing in cross section to show its interior.
Figure 2:
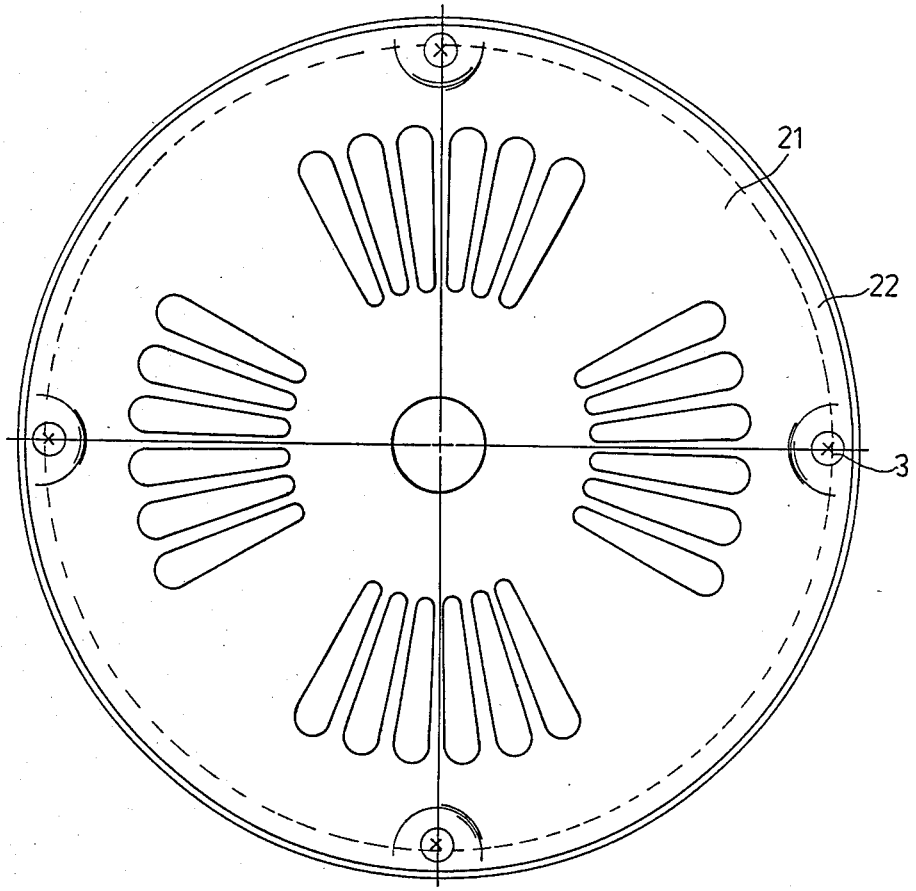
PRIOR ART FIG. 2
FIG. 2 is a top plan view of the conventional ceiling fan of FIG. 1.
Figure 3:
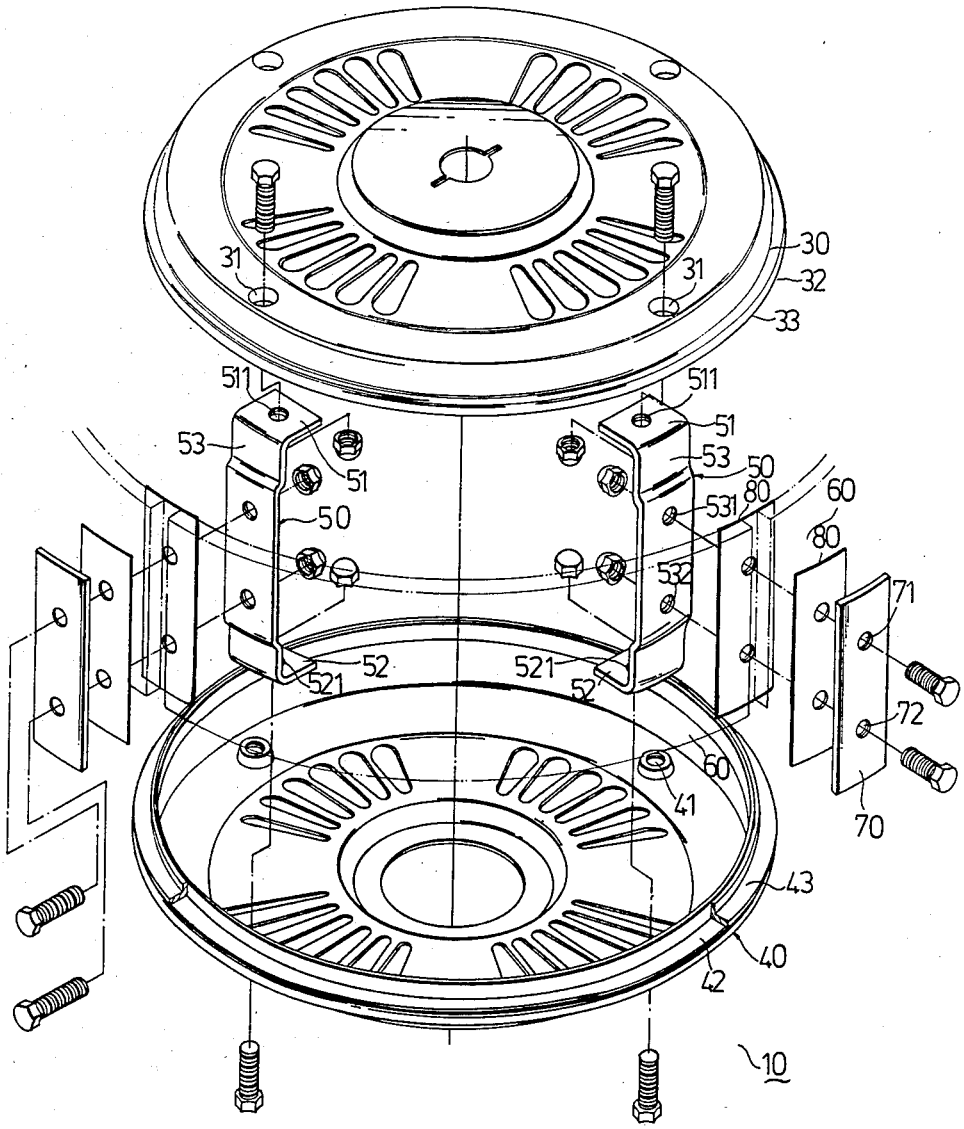
FIG. 3 is an exploded perspectively view of an ornamental casing assembly in accordance with one preferred embodiment of the present invention.
Figure 4:
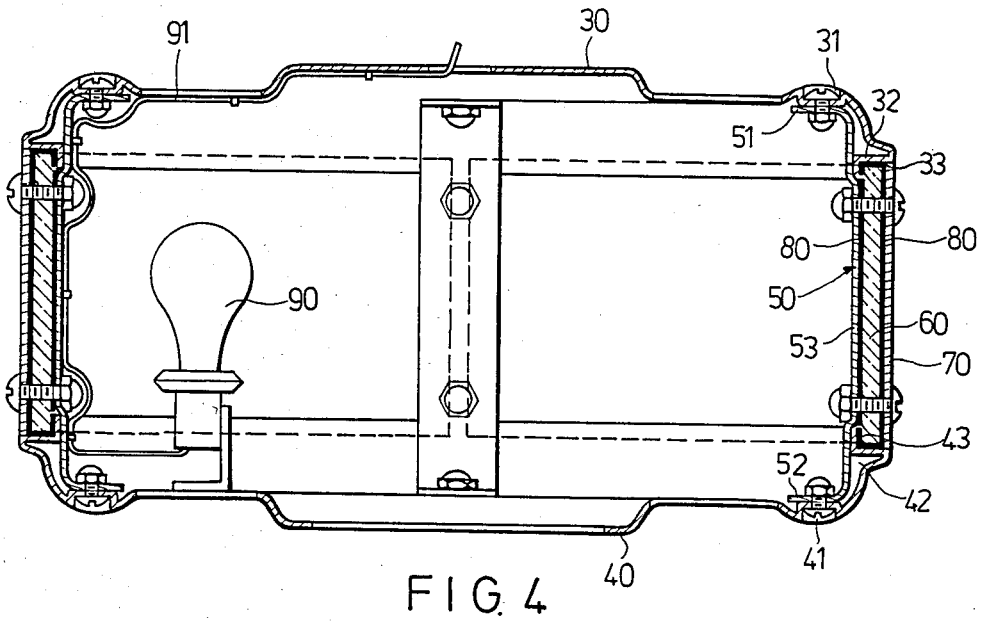
FIG. 4 is a cross sectional view of the ornamental casing assembly of the invention, having a light member mounted therein, taken along the line A—A in FIG. 5.
Figure 5:
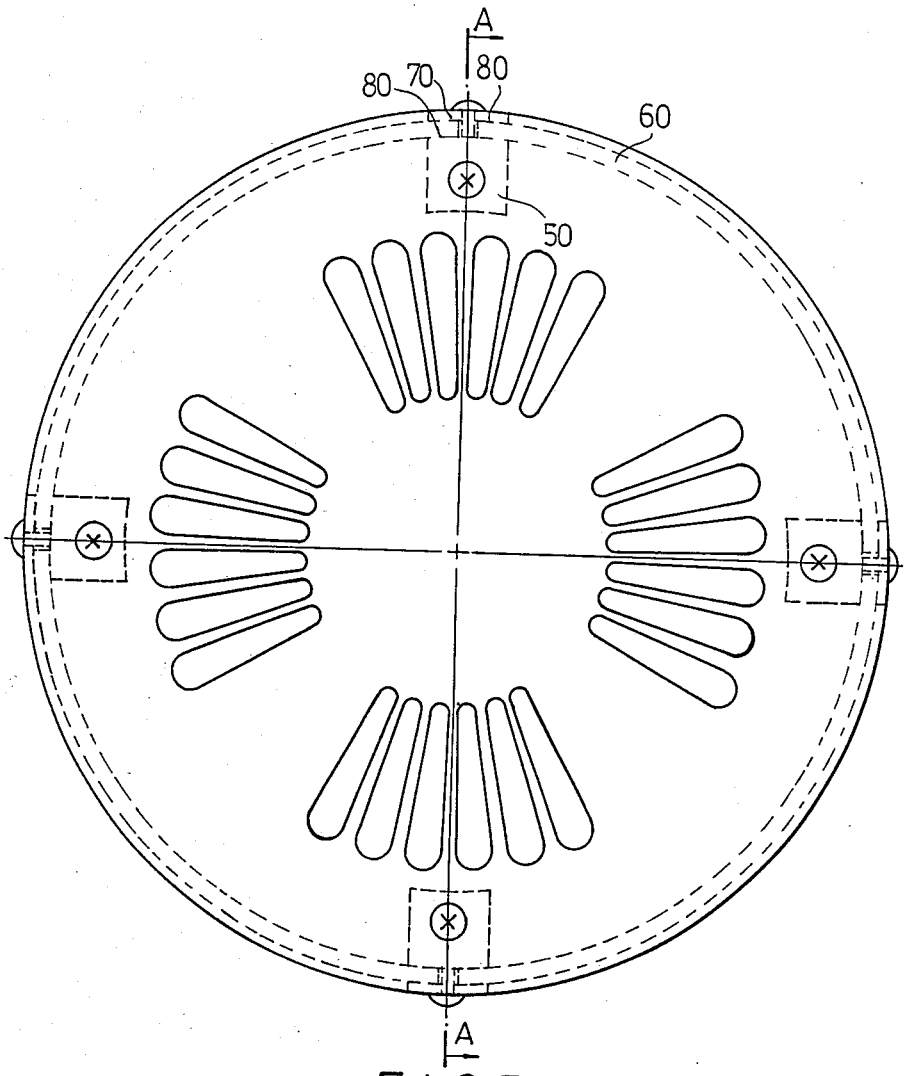
FIG. 5 is a top plan view of the ornamental casing assembly of the present invention.

Referring now to the drawings, it should be noted that a like member is designated with a like reference number. With reference to FIGS. 3, 4 and 5, an ornamental casing assembly 10 is made up of an upper shell 30, a lower shell 40, four connecting members 50, four light-pervious plates 60, four retaining members 70, and a light member 90. The upper shell 30 is adapted to be located above the motor (not shown) of the ceiling fan, and has four circumferentially opposite holes 31. Along the periphery of the upper shell 30 a flat periphery 32 extends inwards therefrom. The flat periphery 32 has a cushioning member 33 fixed thereon to absorb vibration and have a cushion effect.

The lower shell 40 is adapted to be located under the motor of the ceiling fan, and also has four circumferentially opposite holes 41. Along the periphery of the lower shell 40 a flat periphery 42 extends inwards therefrom. The flat periphery 42 has a cushioning member 43 fixed thereon for absorbing vibration and to have a cushion effect.

Each connecting member 50 has a upstanding portion 53 and two extending portions 51 and 52 extended inwards from two ends of the upstanding portion 53 respectively. For illustrative convenience, only two connecting members 50 and two retaining members 80 are shown in FIG. 3. On the two extending portions 51 and 52, two apertures 511 and 521 are provided respectively. On the upstanding portion 53 two orifices 531 and 532 are provided. Each connecting member 50 is connected to the upper shell 30 by a bolt extended through the hole 31 and the aperture 511 to engage with a nut. Also, each connecting member 50 is connected to the lower shell 40 by a bolt extended through the hole 41 and the aperture 521 to engage with a nut. Therefore, the upper and lower shells 30 and 40 are connected and separated at a distance.

The configuration of the four light-perviousness plates 60 is preferably matched accurately to the peripheries of the upper and lower shells 30 and 40. Each of them is positioned between the flat peripheries 32 and 42, and its ends abut respectively against the upstanding portions 53 of two of the connecting members 50. As can be appreciated, the light-pervious plates 60 may be either translucent or transparant, and the light-pervious plates 60 may be made of glass or acrylic resin material.

The retaining members 70 are preferably rectangular in configuration, and have two openings 71 and 72 therethrough corresponding to the orifices 531 and 532 in the upstanding portions 53 of the connecting members 50. When assembled, each retaining member 70 abuts snugly against the ends of two adjacent light-pervious plates, and then is secured to the connecting member 50 by two bolts extended through the openings 71 and 72, and the orifices 531 and 532, respectively, to engage with two nuts. Accordingly, the four light-pervious plates 60 are firmly fixed to the connecting members 50, and forms substantially as a hollow cylinder. Preferably, eight pads 80 are provided between the upstanding portions 53 and the ends of the light-pervious plates 60, and between the ends of the light-pervious plates 60 and the retaining members 70 to absorb vibration and have a cushion effect. The pads 80 may be made of resiliently plastic material, and be substantially rectangular in configuration in agreement with the shapes of the retaining members 70.

The light member 90 may be affixed to the inner surface of the upper shell 30. Alternatively, the light member 90 may preferably be affixed to the inner surface of the lower shell 40. In this case, the power line 91 of the light member 90 to be coupled to the electrical power source is arranged along the inner surfaces of one of the connecting members 50 and the upper shell 30 from the light member 90. Therefore, the power line 91 will not cast a shadow onto the light-pervious plates 60 when the light member 90 is switched on. Moreover, as can be appreciated, the light member 90, in this case, is more convenient for replacement.

It should be noted that the numbers of the connecting members, the light-pervious plates, and the retaining members are not limited to those described above. However, in the present invention, at least two connecting members, two light-pervious plates, and two retaining members are necessary.

With the above construction, the present invention includes several advantages as follows:

(1) The light-pervious plates can be transported individually, thereby significally reducing the likelihood of damage to the light-pervious plates.

(2) If one of the four light-pervious plates is inadvertently broken, only the broken plate needs to be replaced while the other intact plates remain as they are. Therefore, the cost is also reduced.

(3) If the light member is worn-out, one light-pervious plate can be easily removed to allow one to insert a hand or hands to replace the worn-out light member.

While the invention has been described in connection with what is presently considered to be the most practical and preferred embodiment, it is to be understood that the invention is not to be limited to the disclosed embodiment but on the contrary, is intended to cover various modifications and equivalent arrangements included within the spirit and scope of the appended claims which scope is to be accorded the broadest interpretation so as to encompass all such modifications and equivalent structures.

What is claimed is:

1. An ornamental casing assembly for a ceiling fan comprising:

an upper shell, a lower shell, said upper and lower shells each having a flat periphery extending inwardly;

a plurality of connecting members fastened between said upper shell and said lower shell, and separating said upper shell and said lower shell;

a plurality of light-pervious plates mounted between said upper shell and said lower shell, and between said connecting members respectively, the upper and lower portions of said light-pervious plates abutting closely against said flat peripheries of the upper and lower shells, respectively;

a plurality of retaining members secured to said connecting members respectively for retaining said light-pervious plates firmly on said connecting members; and a light member on the inner surface of the said lower shell within the space enveloped by said upper and lower shells and said light-pervious plates, the light member having a power line adapted to be coupled to an electrical power source, the power line being disposed along the inner surfaces of one of said connecting members and said upper shell, therefrom.

2. An ornamental casing assembly as claimed in claim 1, wherein said upper and lower shells all have a cushioning member fixed to their flat peripheries respectively for absorbing vibration and giving a cushion effect.

3. An ornamental casing assembly as claimed in claim 1, further comprising a plurality of pads arranged between said connecting members and said light-pervious plates, and between said light-perviousness plates and said retaining members respectively, for effecting the absorption of vibration and the cushion effect when said retaining members are secured to said connecting members.

4. An ornamental casing assembly for a ceiling fan comprising:

an upper shell;

a lower shell;

a plurality of vertically extending U-shaped brackets having the leg portions thereof fastened to said upper shell and said lower shell adjacent the periphery thereof and separating said upper shell and said lower shell;

a plurality of light-pervious plates mounted between said upper shell and said lower shell adjacent the periphery thereof, and adjacent the surface of the base portion of the U-shaped brackets facing outwardly;

a plurality of retaining members disposed adjacent the outwardly facing surface of said light-pervious plates and secured to said connecting members respectively for retaining such light-pervious plates firmly on said connecting members; and a light member mounted within the space enveloped by said upper and lower shells, and said light-pervious plates.

5. An ornamental casing assembly as claimed in claim 4, wherein said upper and lower shells each have a flat periphery extending inwardly for the upper and lower portions of said light-pervious plates to abut closely against said flat peripheries respectively.

* * * * *

UNITED STATES PATENT AND TRADEMARK OFFICE

CERTIFICATE OF CORRECTION

PATENT NO. : 4,626,970

DATED : December 2, 1986

INVENTOR(S) : Ming C. HUANG

It is certified that error appears in the above—identified patent and that said Letters Patent is hereby corrected as shown below:

Column 1, line 63, delete "needs" and insert --need--;

Column 1, line 68, delete "facilates" and insert --facilitates--;

Column 2, line 27, delete "perspectively" and insert --perspective--;

Column 2, line 59, delete "a" and insert --an--;

Column 3, line 7, delete "perviousness" and insert --pervious--;

Column 3, line 27, delete "forms" and insert --form--;

Column 3, line 27, after "substantially" and before "a", delete "as";

Column 3, line 57, delete "significally" and insert --significantly--;

Column 4, line 45, delete "perviousness" and insert --pervious--.

Signed and Sealed this

Twenty-second Day of September, 1987

*Attest:*

DONALD J. QUIGG

*Attesting Officer* *Commissioner of Patents and Trademarks*